US005873564A

United States Patent [19]

Bisch

[11] Patent Number: 5,873,564

[45] Date of Patent: Feb. 23, 1999

[54] METHOD AND APPARATUS FOR CONSTRUCTING A METAL PICKET FENCE

[76] Inventor: Robert M. Bisch, 8280 Clairmont Mesa Blvd., San Diego, Calif. 92111

[21] Appl. No.: 669,104

[22] Filed: Jun. 24, 1996

Related U.S. Application Data

[63] Continuation-in-part of Ser. No. 345,203, Nov. 25, 1994, Pat. No. 5,581,868.

[51] Int. Cl.[6] ..... E04H 17/14

[52] U.S. Cl. ..... 256/65; 256/59

[58] Field of Search ..... 29/525.02, 525.03, 29/525.04; 206/223, 231; 256/22, 65, 59; 403/328

[56] References Cited

U.S. PATENT DOCUMENTS

| | | | |
|---|---|---|---|
| 3,441,253 | 4/1969 | Blum et al. | 256/65 |
| 3,526,390 | 9/1970 | Horgan, Jr. | 256/65 |
| 3,527,443 | 9/1970 | Blum et al. | 256/65 |
| 3,822,074 | 7/1974 | Welcker | 29/525.02 X |

*Primary Examiner*—Joseph M. Gorski
*Attorney, Agent, or Firm*—Frank D. Gilliam

[57] ABSTRACT

A method of constructing metal picket fences and components for use in building fences. Basically, panels are constructed by punching holes in frame tubes with a punch to form holes. Pickets are inserted into the holes to form fence panels that are fastened to posts. Several embodiments of self-locking pin systems are provided to lock picket ends in frame tube holes to prevent the pickets from being removed. In each embodiment, a pin is mounted on a picket end in a manner such that as the picket end is pressed into a frame tube hole, the pin will move outwardly of the picket wall inside the frame tube and prevent withdrawal of the picket. Straps can be fastened to the posts with fence panels fastened to the straps in a manner permitting accommodation of inter-post tolerances and ground slope changes. Several different embodiments of locking pins, blind fasteners and post or surface mounting brackets are described.

5 Claims, 5 Drawing Sheets

METHOD AND APPARATUS FOR CONSTRUCTING A METAL PICKET FENCE

This application is a continuation-in-part of copending application(s) application Ser. No. 08/345,203 filed on Nov. 25, 1994 and now U.S. Pat. No. 5,581,868.

BACKGROUND OF THE INVENTION

This invention relates in general to metal picket fences and, more specifically, to a method and apparatus for assembling a strong, rigid metal picket fence from pre-formed components.

A wide variety of metal picket fences have been made in the past. Generally, a number of vertical pickets, which may be rods or tubes of metal, are welded to upper and lower cross pieces to form panels. The panels are then fastened to posts, generally by welding where metal posts are used or bolted or screwed fittings where posts of other material are used or where the panel is to be installed over a window or the like. While sturdy, these fences have a number of problems. The welded areas are prone to rusting, even if painted. Where galvanized components are used, welding will destroy the coating at the weld areas, leading to rusting. Since these panels are generally assembled and welded at a factory, panels cannot be varied to accommodate irregular ground surfaces. Welding the panels on site requires complex and heavy jigs and fixtures and welding equipment. Also, considerable skill and time is required to properly assemble the fence panels and fence on site.

Attempts have been made to design fence panels that can be assembled or adjusted on site. These fences and fence construction methods tend to lack sturdiness and ease of assembly. Miller, in U.S. Pat. No. 1,791,680 describes a joint lock for use in the construction of grill-work for fastening bars to rails and rails to posts. Bos describes in U.S. Pat. No. 3,411,752 a guardrail construction that may be delivered to a site in a knocked-down condition an erected there. U.S. Pat. No. 3,707,276, issued to Fraincis et al. describes a variety of aluminum rail extrusions for fence construction, with pickets pivoted to the rails by bolts extending through the pickets and top and bottom rails. Each of these fences construction systems suffers from the problems described above.

Thus, there is a continuing need for improved methods and apparatus for constructing metal picket fences that can be conveniently assembled on site from standard components, that provide a sturdy and long lived fence, that can be assembled from galvanized components without damaging or destroying the galvanized coating.

SUMMARY OF THE INVENTION

The above-noted problems, and others, are overcome in accordance with this invention by a method and apparatus which basically comprises preparing a number of pickets and frame tubes, assembling them into fence panels with pickets locked into holes in the frame tubes, adding mounting brackets to the panels and mounting the panels on posts, a wall surface to cover a window, etc.

Preferably, the pickets are metal tubes and the frame tubes are metal tubes with internal diameters greater than the external diameters of the pickets. While any suitable cross sectional shapes may be used, such as rectangular, circular, etc., square tubes are preferred for efficient interconnection and appearance. While usually two frame tubes are used with a plurality of parallel pickets extending between them, or extending beyond one of the frame tubes, more than two frame tubes may be used, if desired, with pickets extending through central frame tubes.

Holes are punched at spaced locations along frame tubes, preferably with a punch that produces a clean hole, free from burrs or obstructions, corresponding in shape to the cross section of the pickets. Where the ends of the pickets are to stop in top and bottom frame tubes, both the top and bottom frame tubes will be punched in an identical pattern. In some cases, it may be desirable that pickets extend through the top frame tube, typically ending in a spear point or other decorative final. In that case, smooth holes equal in shape to the picket cross section will be punched all the way through the top frame tube. The picket will be fed through the holes in the top frame tube then forced into the one-side hole in the bottom frame tube. Of course, the picket must then be fastened to the top rail by a transverse pin.

In order to lock a picket end in a frame tube, a pin hole is formed, typically by drilling or punching, in the wall (preferably at the corner of a rectangular tube) perpendicular to the picket centerline for receiving a locking pin. A plastic plug extends into the end of the picket to just beyond the lock pin hole. A hole is formed in the plastic plug coaxial with the picket lock pin hole. The plastic plug may be solid or tubular and preferably includes an outward flange at the outer end to engage the end of the picket so that the plug is precisely positioned within the picket.

A locking pin is placed in the lock pin hole, substantially flush with the hole. Each end of the pin extending into the plug is chamfered or beveled.

A drive pin hole is formed in the plastic plug along and edge opposite the lock pin hole, extending parallel to the picket centerline. A drive pin having an angled first end is inserted into the drive pin hole until the angled end engages the lock pin bevel. The second end of the drive pin extends beyond the outer end of the plug and picket.

The picket is assembled to a frame tube by pushing the picket end into a corresponding frame tube. The second end of the drive pin encounters the far wall of the frame tube. When the picket is forced fully into the frame tube, the drive pin is forced up so that the angled end engages the lock pin and wedges the lock pin transversely, forcing the lock pin to extend out of the picket wall, just inside the frame tube and preventing withdrawal of the picket.

Any suitable brackets may be used to fasten the fence panels to posts or other surfaces. A strap may be fastened across a post, preferably with a non-removable blind fastener and fence panels can be fastened to ends of the strap, also preferably with blind fasteners. A particularly desirable blind fastener is described in detail below. If desired, the strap can be recessed into a post by the method detailed below.

For surface mounting fence panels, such as to cover a window, attractive angle brackets may be made by inwardly pinching opposite sides of metal tubes, then bending the tubes transverse to the pinched sides, as detailed below.

Another embodiment of an arrangement for locking a picket into a frame tube is illustrated in FIGS. 17–19. here, a bent spring wire pin is configured to lie diagonally across the interior end of a tubular picket.

The pin includes a first leg to be positioned along a first inside corner, a return bend to extend just beyond the picket end prior to installation and a second leg extending along a second inside picket corner opposite the first corner, approximately parallel to the first leg and having an outwardly extending end. The distance between the two legs is normally greater than the distance between the first and second corners, so that the legs must be moved towards each other for insertion into the picket and are spring biased outwardly.

A hole is provided through the second corner, sized to receive the pin end and spaced slightly further away from the picket end when the pin is positioned with the loop extending beyond the picket end.

The picket is installed in a corresponding hole in a side of a frame tube by pressing the picket into the tube until the pin loop forcefully contacts the far side of the frame tube, which pushes the pin upwardly into the picket, bringing the pin end into alignment with the picket hole, so that the pin biasing forces cause the pin end to extend outwardly through the hole. The pin second leg length and picket hole location are selected so that the pin end extends just inside the frame tube to prevent removal of the picket and to prevent significant movement of the picket transverse to the frame tube.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 2:
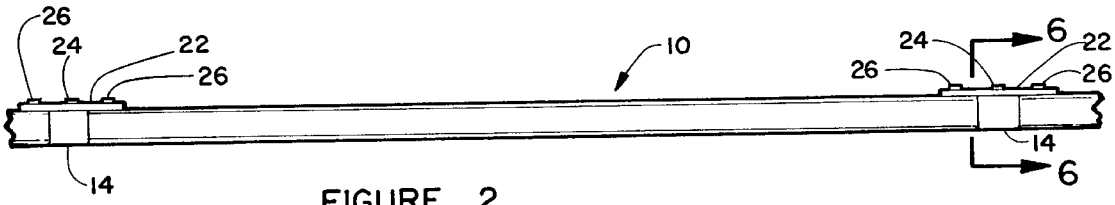
FIG. 2 is a plan view of the fence section of FIG. 1.
Figure 1:
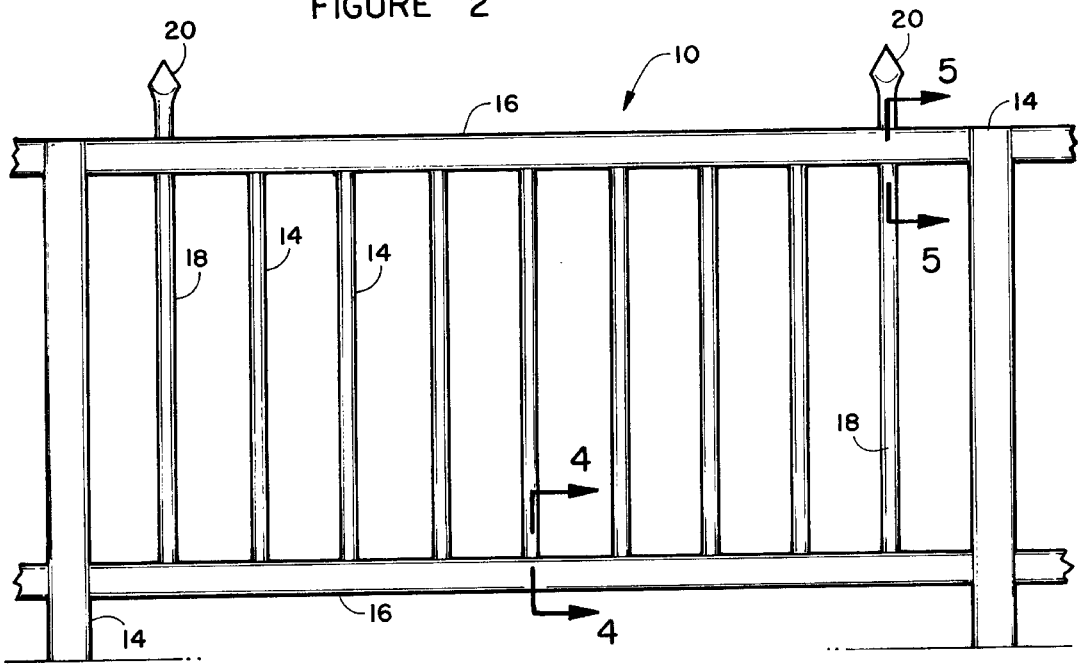
FIG. 1 is an elevation of a fence section according to this invention.

Referring to FIGS. 1 and 2, there is seen a fence section including a fence panel 10 and two posts 12. Each fence panel 10 includes a plurality of pickets 14 and frame tubes 16. While most pickets 14 are shown with each end inserted into, and terminating within, a frame tube 16, two through pickets 18 extend through upper frame tube 16 and have decorative finals 20.

Each frame tube 16 is fastened to posts 14 by straps 22 held to posts by fasteners 24 and to frame tubes 16 by fasteners 26. While any suitable fasteners may be used, the blind fasteners and bolts detailed below are preferred for appearance, effectiveness and reduced removability.

Figure 3:
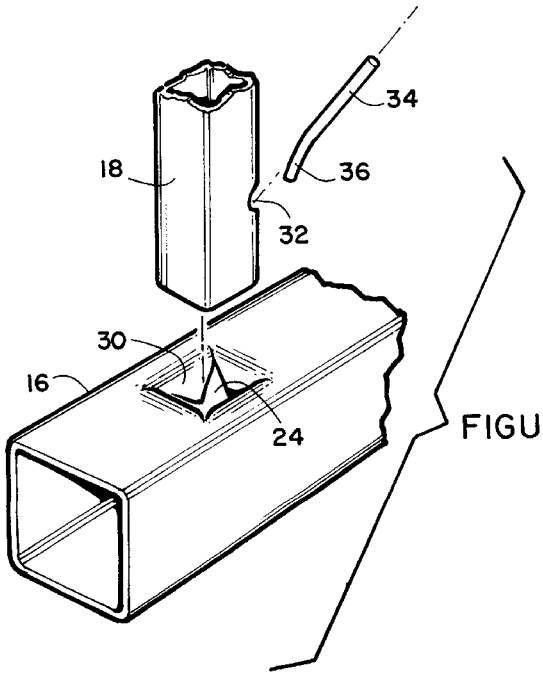
FIG. 3 is an exploded view of the connection of a picket to a frame tube.

As seen in FIG. 3, picket holes 28 are formed in frame tubes 16 by punching with a conventional pyramidal punch. The punch cuts the tube wall in a generally "X" shaped pattern and folds metal tabs 30 downwardly along each side of the hole. Preferably, the tabs form a hole 28 slightly smaller than the cross section of picket 14, but generally conforming thereto in shape. Thus, as picket 14 is forced into hole 24, the walls of the hole tightly and with a spring-like action engage the picket sides.

Figure 4:
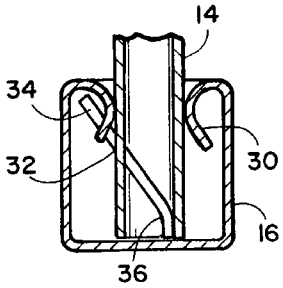
FIG. 4 is a detail section view taken on line 4—4 in FIG. 1.

A locking mechanism, as seen in FIGS. 3 and 4, is provided to retain pickets 18 in holes 24 and prevent withdrawal of the pickets. A pin hole 32 is formed in the wall of picket 18 adjacent to the picket end by any suitable method, such as punching or drilling. Preferably, the pin hole is formed in a corner of a rectangular picket and is angled toward the intersection of the opposite edge and picket end for maximum holding power. A pin 34, preferably a sliding fit, is inserted into pin hole 32. The length of pin 34 is selected so that when pin 34 is inserted flush with pin hole 32, the opposite end extends slightly beyond the end of picket 18. Ideally, pin 34 and pin hole 34 are configured so that the lower end of pin engages the opposite picket wall with sufficient spring force to hold the pin in place.

When picket 14 is forced into hole 28, as seen in FIG. 3, and the picket end bottoms out against the interior wall of frame tube 16, pin 34 will be forced up into the picket end, forcing the other end of the pin out through pin hole 32. This overlaps the edge of hole 24, preventing removal of picket 18. In the optimum configuration, as shown, pin hole 32 is in a corner of a rectangular picket 18 and the pin end 36 is in the opposite corner. Then, when installed, the upper pin end fits between adjacent metal tabs 30 close to the upper wall of frame tube 16. End 36 of pin 32 is preferably bent slightly so that the end lies generally perpendicular to the lower inner wall of frame tube 16 when emplaced to provide the optimum line of installation force. Optimally, the last 5 to 20 percent of the pin is bent from about 5° to 200°. The length of pin 34, pin hole 32 location and precise bend angle will be selected in accordance with the diameters of frame tube 16 and picket 18.

Figure 5:
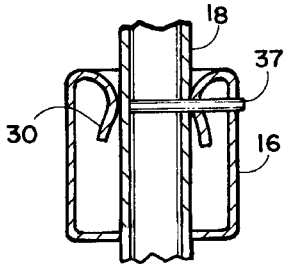
FIG. 5 is a detail section view taken on line 5—5 in FIG. 1.

Once a fence panel 10 is assembled, the assembly may be adjusted to match sloping ground, etc, by simply moving upper frame tube 16 longitudinally relative to the other frame tube, "parallelograming" the panel. Such a panel can be mounted between parallel vertical posts on sloping ground.

Where a picket 18 extends through a frame tube 16, as seen in FIG. 5, in order to secure the picket and tube together, preferably a pin 37 is installed in a hole drilled perpendicular to the surface of frame tube 16 and one side of picket 18. If pin 37 is installed in a hole drilled through both the outer wall of frame tube 16 and a tab 30, the pin will be resistant to movement of picket 18. If desired, the pin could extend through the second side of picket 18 and a second tab 30.

The fence panels as detailed in FIG. 1–5 can be installed on posts, surfaces, etc, using any suitable brackets.

However, certain preferred brackets, providing optimum strength, adjustability and appearance, are detailed in FIGS. 6–12.

Figure 6:
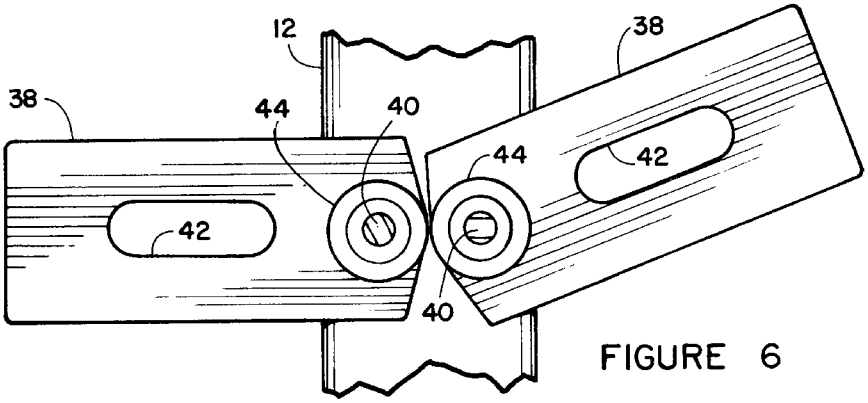
FIG. 6 is a detail elevation view showing one bracket arrangement for mounting fence panels on posts.

FIG. 6 shows a post 12 having two straps 38 fastened thereto by blind fasteners 40. Elongated openings 42 in straps 38 are provided through which fasteners may be inserted into ends of frame tubes 16 in panels 10. Blind fasteners 40 may be used to fasten straps 38 to frame tubes 16 through elongated openings 42. Preferably, washers 44 are provided with fasteners 40 to allow the straps 38 to swivel slightly. The abutting edges 46 are curved to allow independent swiveling of each strap 38. Straps 38 and elongated holes 42 thus can accommodate a change from level to sloping ground and some irregularity in the spacing of posts 12.

Figure 7:
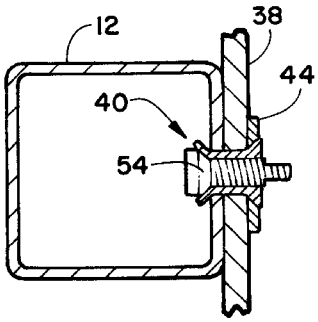
FIG. 7 is a section view through a novel blind fastener taken on line 7—7 in FIG. 9.
Figure 8:
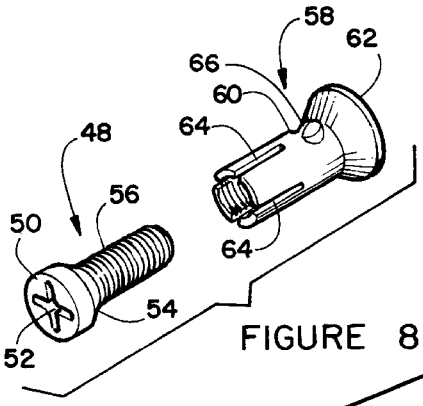
FIG. 8 is an exploded view of the blind fastener of FIG. 7, having a first rotation preventing means.

FIGS. 7 and 8 illustrate one embodiment of a novel blind fastener particularly adapted for use in the fence system. Each blind fastener 40 comprises a bolt 48 having an enlarged head 50 and a means, such as Phillips head screwdriver slots 52, for turning the bolt. A frusto-conical transition 54 is provided between enlarged head 50 and threaded shaft 56. A sleeve 58 has a cylindrical tubular body 60, internally threaded to receive bolt 48. An enlarged frusto-conical head 62 is provided at one end of sleeve 58. The second end of sleeve 58 includes at least one longitudinal slot 64.

Where blind fastener 40 is to be placed in an elongated slot such as slot 42 or a round hole, it is preferred that sleeve 58 not rotate while bolt 48 is threaded thereinto. In the embodiment of FIG. 8, a small amount of metal is "pinched in a conventional press type device, to raise a metal tab 66. Tab will bind against a side of elongated slot 42 and prevent rotation. A small tab 66 can be used with a round hole to cause greatly increase friction and reduce turning of sleeve 58. The end of threaded shaft 56 is ground on two sides to form a thin, flat, extension 68.

The blind fastener 40 is installed by inserting bolt 68 from one side and sleeve 58 from the other side. Shaft 56 is threaded into the internal threads in sleeve 58. When conical transition 54 reaches the edge of sleeve body 60, extension 68 projects beyond sleeve head 62. Slots 52 are engaged with a screwdriver and turned to fully seat bolt 48 in sleeve 58, spreading the sleeve end as seen in FIG. 7.

Figure 9:
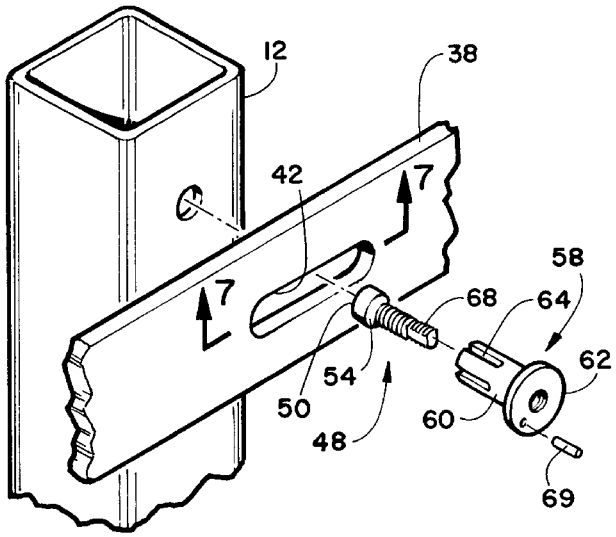
FIG. 9 is an exploded perspective view showing installation of a blind fastener having a second rotation preventing means.

FIG. 9 shows an alternate embodiment of the blind fastener of FIG. 8. Here bolt 48 is generally the same as in FIG. 8, except that the threaded shaft 56 is longer and the end is ground on opposite sides to form a flat extension 68. As bolt 48 is threaded into sleeve 58, extension 68 protrudes through sleeve head 62 and can be gripped with a conventional wrench to fully seat the bolt in the sleeve, to the point shown in FIG. 7. Further torque on extension 68 will snap the extension off, leaving a smooth surface and a fastener that cannot easily be removed. In order to prevent rotation of sleeve 58 during rotation of bolt 48, a pin 69 is installed through head 62 so that the end of the pin extends into slot 42 adjacent to sleeve body 60 and binds against the edge of the slot.

Figure 10:
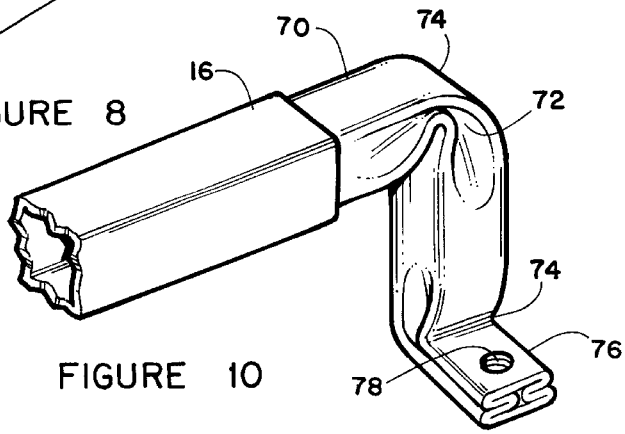
FIG. 10 is a perspective view showing a bracket for mounting a fence panel on a parallel surface.
Figure 12:
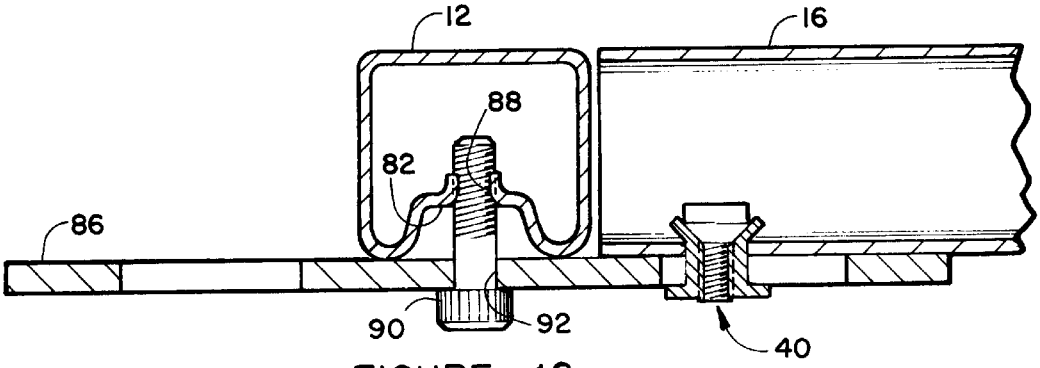
FIG. 12 is a section view taken on line 12—12 in FIG. 11 with a further blind fastener installed.
Figure 11:
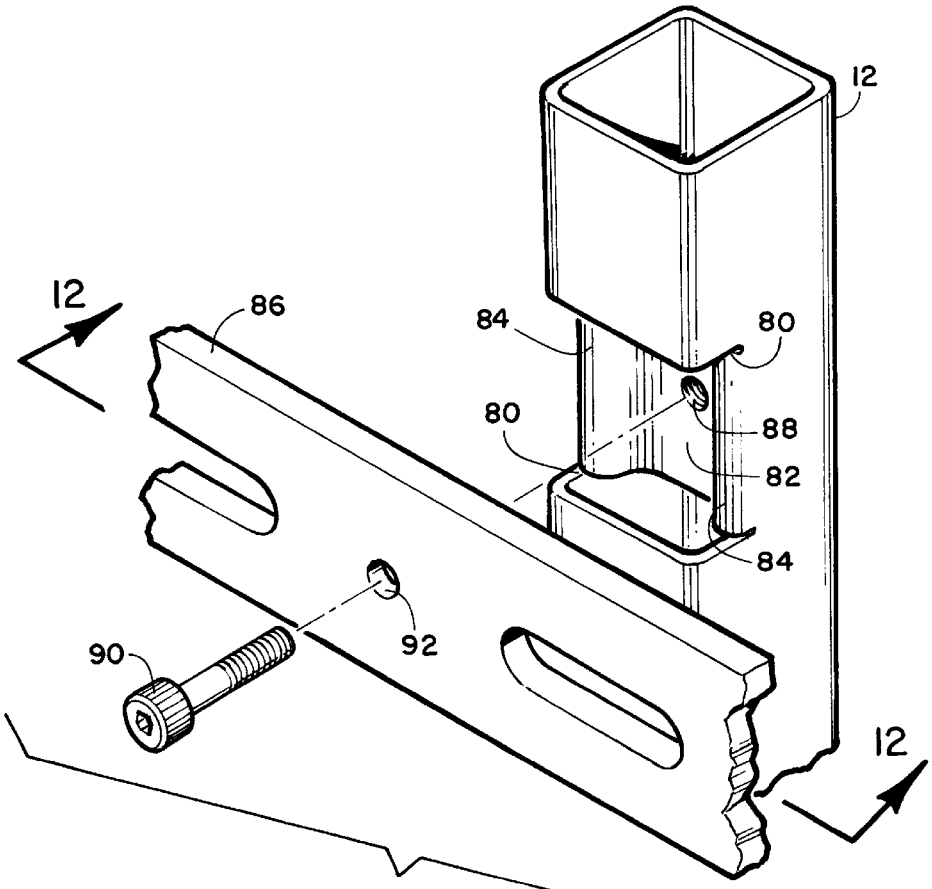
FIG. 11 is an exploded perspective view showing installation of a fence panel mounting strap recessed into a post.

A bracket for use in mounting a fence panel over a surface, such as a window, is illustrated in FIG. 10, A piece of tubing 70 having an external diameter such as to slide into a frame tube 16 is pressed between two blade-shaped members to indent those sides to form opposing indentations 72. Tube 70 can then easily be bent transverse to those indentations into a smoothly curved bend 74. The sides that were not indented are then indented so that a bend at about 90° to the first bend 74 can be formed. The tube bend is then pressed to form a thin, flat end 76. A hole 78 is formed in end 76 for a fastener such as a screw or bolt.

Where the interior of a post 12 cannot be accessed to use a blind fastener, the fastening technique shown in FIGS. 11 and 12 is preferred. Two spaced slots 80 are cut transverse to post 12 as seen in FIG. 11. A punch with a flat, rectangular end is used to punch the material between slots 80 to form a flat recessed surface 82. The punch distance is selected to provide edges 84 a predetermined distance beneath the surface of post 12, generally equal to the thickness of the strap 86 to be used.

A second punch, typically a round, pointed punch, is used to punch the center of recess 82 to form a short tubular opening 88 which is then threaded with a conventional tap. If necessary, opening 88 can be reamed in a conventional manner prior to taping.

A strap 86, preferably having a width and thickness such that the strap will fit between slots 80, flush with the surface of post 12. Any suitable bolt 90 is installed through a hole 92 in strap 86 and threaded into opening 88. A fence panel frame tube 16 can then be secured to strap 86 by a blind fastener 40 as seen in FIG. 12 and described above. In many cases, a one-way bolt head may be preferred on bolt 90 to allow the bolt to be threaded into hole 88 but prevent removal, or a bolt with a snap off head portion may be used.

A second method and apparatus for locking fence pickets to fence frames is illustrated in FIGS. 13–16.

Figure 13:
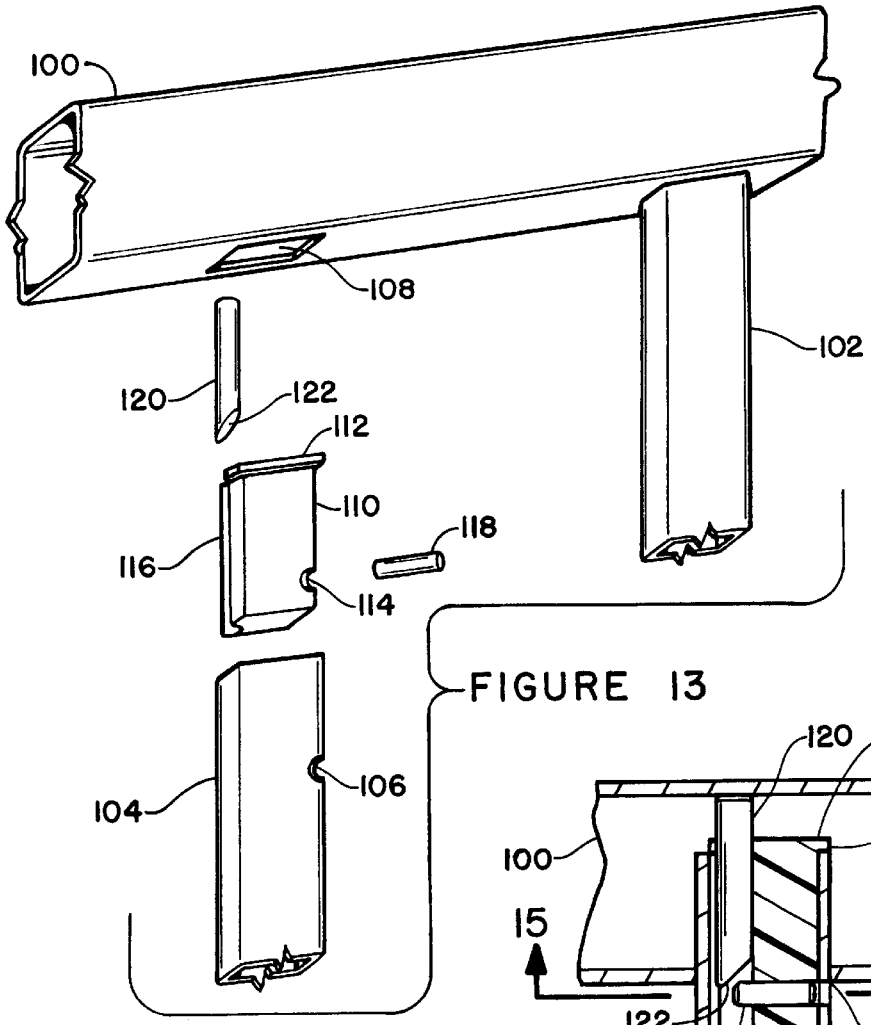
FIG. 13 is an exploded view of a second embodiment of means for connecting a picket to a frame tube.

FIG. 13 shows all of the components of this locking system in exploded view. Frame tube 100, in this case an upper frame tube, is shown with one picket 102 installed and a second picket 104 ready for assembly and installation in a corresponding hole 105. Lower frame tubes and pickets are assembled in the same manner, inverted from the showing in FIG. 13.

Picket 104 has a sidewall hole 106, preferably formed by punching, drilling or the like at a corner. While the corner location for hole 106 provides optimum interlocking, the hole could be between corners, if desired. Hole 106 is located so as to be entirely within frame tube 100 when picket 104 is fully inserted in frame hole 108. For most rigid locking, it is preferred that hole 106 be just barely inside frame tube 100, as detailed below.

A plug 110 is sized to snugly fit within an end of a picket 104 and preferably has a narrow flange 112 to prevent the plug from being pushed fulling into a picket. While plug 110 may be formed from any suitable material, a tough plastic such as polyethylene, polypropylene, Nylon or the like is preferred. A transverse hole 114 (extending in the embodiment shown from corner to corner) is formed in plug 110 to align with hole 106 when plug 110 is inserted in picket 104. A longitudinal hole 116 is formed in plug 1101 extending from the flanged plug end to an intersection with transverse hole 114.

Figure 14:
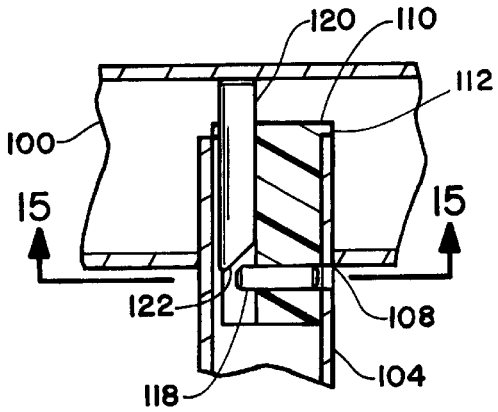
FIG. 14 is a elevation view, partially cut-away, showing the embodiment of FIG. 13 in an initial installation position.

A transverse pin 118, sized to fit in holes 106 and 114, is pressed into those holes, as best seen in FIG. 14. The inner end of pin 118 extends into longitudinal hole 116 when the outer end of the pin is flush with, or just inside, the surface of picket 104.

A longitudinal pin 120 is sized to fit and be frictionally held in longitudinal hole 116, with a tapered end 122 in contact with pin 118 and the second end of pin 120 extending beyond plug 110, as best seen in FIG. 14.

Figure 15:
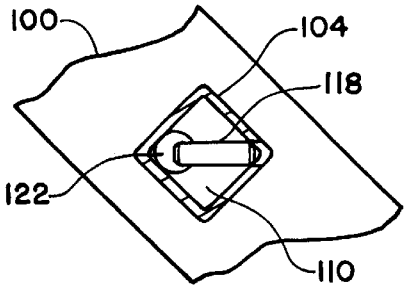
FIG. 15 is a section view taken on line 15—15 in FIG. 14.

FIGS. 14 and 15 illustrate the initial step in installing and locking a picket 104 in a frame tube 100. The end of a picket 14 is inserted into a frame tube 100 until the end of pin 120 contacts the opposite internal wall of the frame tube. Then picket 104 is forced further into frame tube 100, typically by placing a wood block over the frame tube or opposite end of the picket to prevent damage and lightly hammering thereon.

Figure 16:
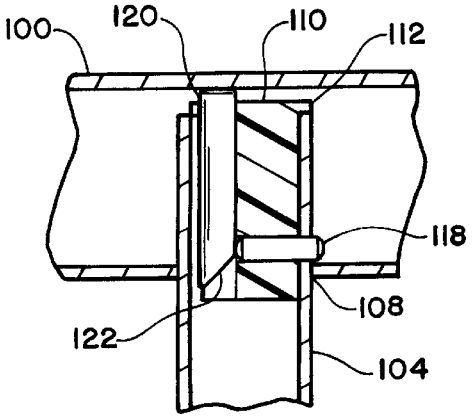
FIG. 16 is a elevation view, partially cut-away, showing the embodiment of FIG. 13 in the final installation position.

As picket 104 moves further into frame tube 100, the angled end 122 of pin 120 drives pin 118 transversely, until the end of pin 118 projects inside tube 100, as seen in FIG. 16. While the projecting end of pin 118 could be at any place across the width of tube 100 and prevent withdrawal of the picket 104, it is preferred that pin length and initial position of the flush or nearly flush end of pin 118 be selected so that the projecting end is quite close to the wall of tube 100 adjacent to tube hole 108.

The embodiment of FIGS. 13–16 provides a very clean appearing connection, with the edges of hole 105 smoothly engaging the inserted picket. Where the fence is a security fence, a window grill, etc., a thief would have great difficulty in removing a picket from a frame tube and would have to cut one or the other.

Fence panels made as illustrated in FIGS. 13–16 are preferably secured to supporting structures in the manner described above in the discussion of the first embodiment of this invention.

Figure 17:
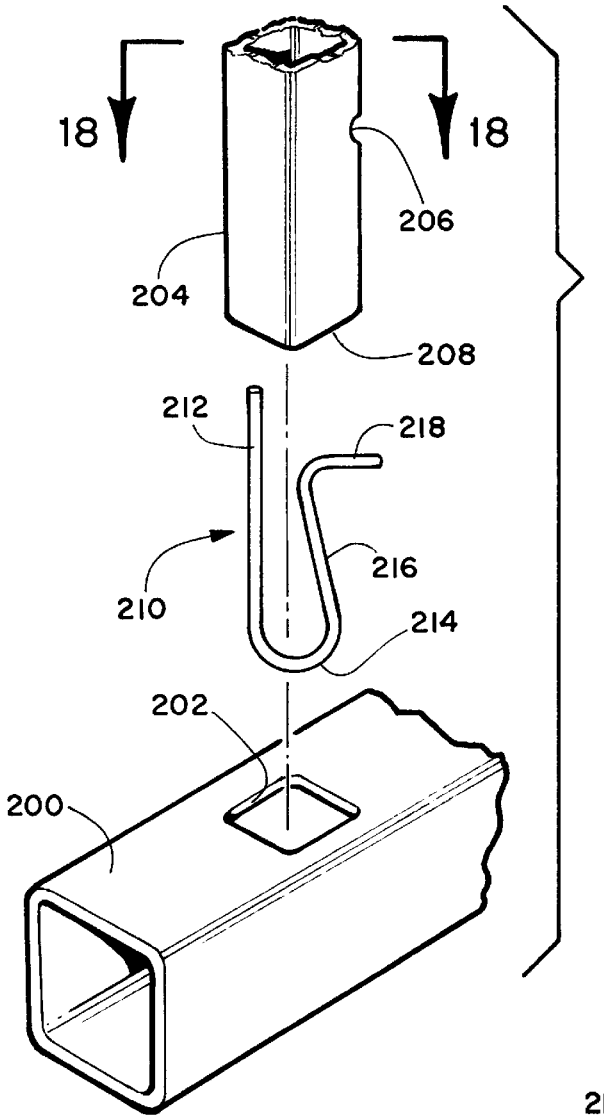
FIG. 17 is an exploded perspective view of another embodiment of the invention using a bent spring retaining pin.
Figure 18:
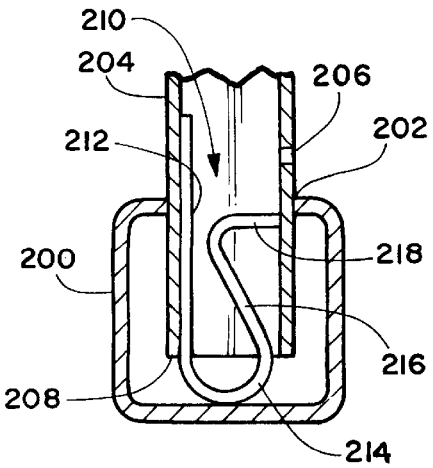
FIG. 18 is a diagonal section view taken on line 18—18 in FIG. 17 with the picket to frame connection nearly in place.
Figure 19:
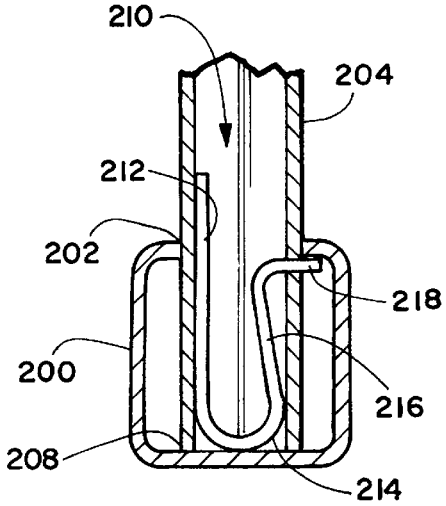
FIG. 19 is a diagonal section view taken on line 18—18 in FIG. 17 with the picket to frame connection fully in place and locked.

FIGS. 17–19 show a further embodiment of a means for locking a picket to a frame tube, which may be a top and/or bottom frame tube of the sort described above. Frame tube 200 has a clean hole 202, preferably formed by punching, corresponding to the exterior dimensions of picket 204. A pin hole 206 is formed in one corner of picket 204, adjacent to first picket end 208, such as by drilling or punching.

A pin 210 is formed from an elastic, spring-like metal that will attempt to return to an original shape when slightly deformed. Pin 210 includes a first, generally straight leg 212, a return bend 214 and a second leg 216 approximately parallel to the first leg and having an outwardly extending end portion 218. The combination of legs 212 and 216, bend 212 and end portion 218 preferably lie in a single plane.

Pin 210 is installed in first picket end 208 by forcing legs 212 and 216 together and sliding the pin into the end diagonally across picket 204. Locations of pin hole 206 and pin end portion 216 are predetermined so that the end portion is located adjacent to and on the first end 208 side of the pin hole when reverse bend 212 extends lightly out of first picket end 208. Spring forces and friction along the interior wall of picket 204 keep pin 210 in place. When first end 208 of picket 204 is forced into hole 202, reverse bend 208 encounters the far interior wall of frame tube 200. With further insertion, pin is moved upwardly in picket 204, with first leg 212 sliding along the interior corner of the picket. Pin end portion 218 approaches and enters pin hole 206 as the pin hole passes through hole 202. Eventually, pin end portion 218 "snaps" through pin hole 206 and engages the interior wall of frame tube 200 adjacent to hole 202 to lock picket 204 to frame tube 200.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A kit for use in construction of a picket fence panel which comprises:

a plurality of tubular metal pickets;

each of said pickets having a locking pin hole through a wall of each of said picket adjacent to and spaced from a first picket end;

at least one frame having a plurality of holes for receiving a said first picket end;

a plurality of plugs for insertion unto said first picket ends with a first plug end at said first picket end;

means for retaining said plugs within to said first picket ends;

each plug having a transverse hole for becoming aligned with said locking pin hole when said plug is inserted in said first picket end, and a longitudinal hole extending from said first plug end to an intersection with said transverse hole;

said transverse hole opening into said longitudinal hole;

a locking pin for insertion in each said locking pin hole and an aligned transverse hole;

a drive pin having an angled first end for insertion in each longitudinal hole;

said drive pin having a length sufficient that a second end of said drive pin extends beyond said first plug end when said drive pin is in said longitudinal plug hole and said angled first end is in contact with said locking pin at said intersection of transverse and longitudinal plug holes;

said locking pin having a length such as to project from said locking pin hole outside said picket after said locking pin has been contacted with said angled end of said drive pin; and said drive pin being sized to be maintained in said longitudinal hole by friction between said drive pin and walls defining said longitudinal hole;

whereby insertion of a said first picket end fully into a said frame tube hole will bring said drive pin first end into operative contact with a first internal surface of said frame tube opposite said frame tube hole to force said angled first end against said locking pin and drive said locking pin such that said locking pin projects from said locking pin hole outside said picket and comes into locking engagement with a second internal surface of said frame tube within said frame tube.

2. The kit according to claim 1 further including means for mounting said panel on a structure which comprises:

a frame member;

at least one elongated strap having an elongated first hole adjacent to a first end of said strap;

means spaced from said elongated first holder for fastening said strap to a structure;

a frame member hole adjacent to an end of said frame member;

a blind fastener for placement through said elongated first hole and said frame member hole for connecting said strap to said frame member.

3. The kit according to claim 2 wherein said blind fastener comprises:

a bolt having an enlarged head, a frusto-conical transition between said head and a threaded shaft, and a flat end opposite said enlarged head;

a sleeve member having a cylindrical body, and an external diameter, internally threaded to thread onto said bolt, an enlarged head at a first end and at least one longitudinal slot at a second end;

means for threading said bolt into said sleeve; and means for preventing rotation of said sleeve member when said sleeve member is placed in an elongated hole having a smallest diameter substantially equal to the external diameter of said sleeve.

4. The kit according to claim 3 wherein said means for preventing rotation of said sleeve member comprises a pin extending through said enlarged sleeve head and extending parallel to said cylindrical sleeve body.

5. The kit according to claim 3 wherein said means for preventing rotation of said sleeve member comprises a least one pinched area on said cylindrical sleeve body so that sleeve has a greater diameter at that location than said external diameter.

* * * * *